US007281999B1

(12) United States Patent
Miller et al.

(10) Patent No.: US 7,281,999 B1
(45) Date of Patent: Oct. 16, 2007

(54) CATER-CORNERED BASKETBALL BACKBOARD AND HOOP

(76) Inventors: Arthur Miller, 45 Orchard Ct., Woodbury, NY (US) 11797; Alfred Farina, 16 Anita Ct., Baldwin, NY (US) 11510; James Dodich, 971 Boulevard, New Milford, NJ (US) 07646

( * ) Notice: Subject to any disclaimer, the term of this patent is extended or adjusted under 35 U.S.C. 154(b) by 143 days.

(21) Appl. No.: 11/337,853

(22) Filed: Jan. 24, 2006

(51) Int. Cl.
*A63B 63/08* (2006.01)

(52) U.S. Cl. ..... 473/481; D21/705

(58) Field of Classification Search ..... 473/481, 473/479, 480; D21/701–703; 273/400, 273/401

See application file for complete search history.

(56) References Cited

U.S. PATENT DOCUMENTS 4,468,027 A * 8/1984 Pangburn ..... 473/481
4,926,060 A * 5/1990 Sittig ..... 273/400
4,973,054 A * 11/1990 Metrosky ..... 473/481
5,089,355 A 2/1992 Morita et al.
5,098,108 A * 3/1992 McKinney ..... 273/400
5,224,699 A * 7/1993 Zaruba ..... 273/375
5,827,136 A * 10/1998 Halter et al. ..... 473/447
6,344,005 B1 * 2/2002 Lin ..... 473/415
6,398,673 B1 * 6/2002 Maruca ..... 473/481
2002/0187864 A1 * 12/2002 Griswold ..... 473/483
2005/0137036 A1 * 6/2005 Smith ..... 473/481

* cited by examiner

*Primary Examiner*—Eugene Kim
*Assistant Examiner*—M. Chambers
(74) *Attorney, Agent, or Firm*—Myron Amer, P.C.

(57) ABSTRACT

An indoor basketball backboard and hoop positioned in an unfolding mode in a cater-corner orientation to maximize play area and in proximity to a door to cause opening movement of the door to restore by folding the backboard and hoop into a flat storage condition on the back of the door.

2 Claims, 5 Drawing Sheets

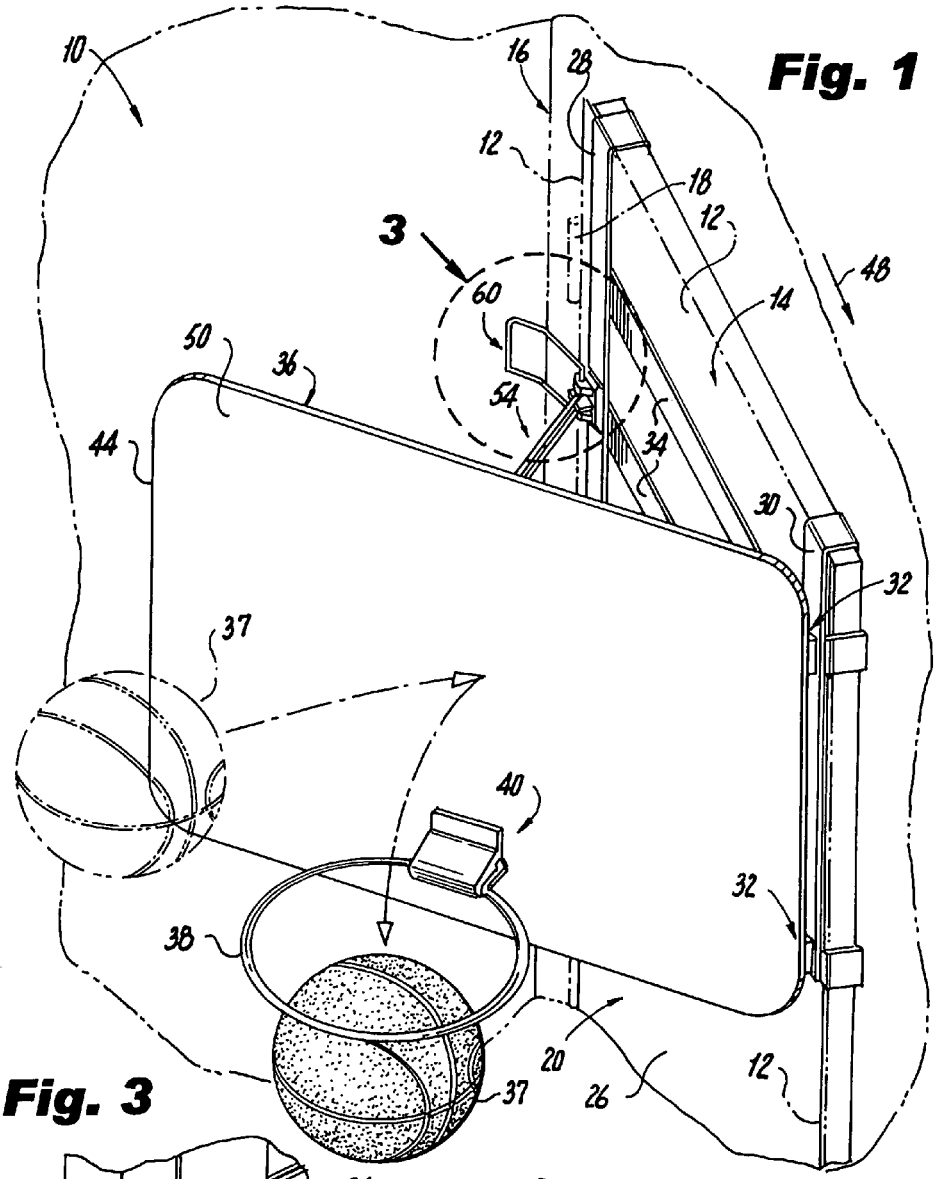
Fig. 1
Fig. 3
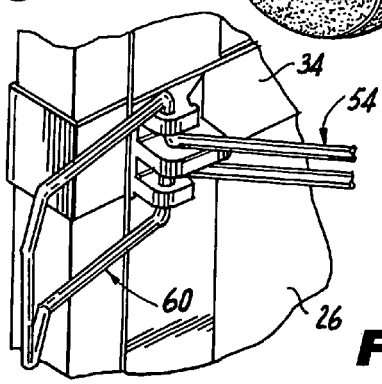
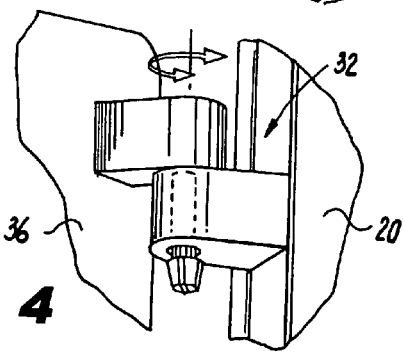
Fig. 4

CATER-CORNERED BASKETBALL BACKBOARD AND HOOP

The present invention relates generally to improvements in indoor basketball activity, the improvements more particularly advantageously using the long diagonal dimension of a rectangularly shaped room and a closed position of a room door of mounting the backboard and hoop but without inhibiting opening the door if circumstances so require, all as will be better understood as the description proceeds.

BACKGROUND OF THE INVENTION

It is already known from U.S. Pat. No. 5,080,355 for Basketball Hoop Structure that the diagonal expanse of a rectangular room provides an optimum play area in facing relation to the structure which, in turn, in the prior art has dictated a location directly in the corner of the room. The tradeoff however is that a door is never provided directly in a room corner and thus the door cannot be used as a support for the basketball backboard and hoop, although it is desirable for this end use.

BRIEF SUMMARY OF THE INVENTION

It is an object of the present invention to overcome the foregoing and other shortcomings of the prior art.

More particularly, it is an object to achieve an optimum play area by a cater-corner orientation of the backboard, and to do so in a proximity to a room door which enables use of the door for support of the backboard and hoop.

The description of the invention which follows, together with the accompanying drawings should not be construed as limiting the invention to the example shown and described, because those skilled in the art to which this invention appertains will be able to devise other forms thereof within the ambit of the appended claims.

BRIEF DESCRIPTION OF THE SEVERAL VIEWS OF THE DRAWINGS

FIG. 1 is a perspective view of an indoor basketball backboard and hoop according to the present invention;

FIG. 3 is a detail illustration of structural features within the area denoted by arrow 3 in FIG. 1;

FIG. 4 is a detail illustration of structural features within the area denoted by arrow 4 of FIG. 2;

DETAILED DESCRIPTION OF THE INVENTION

Figure 2:
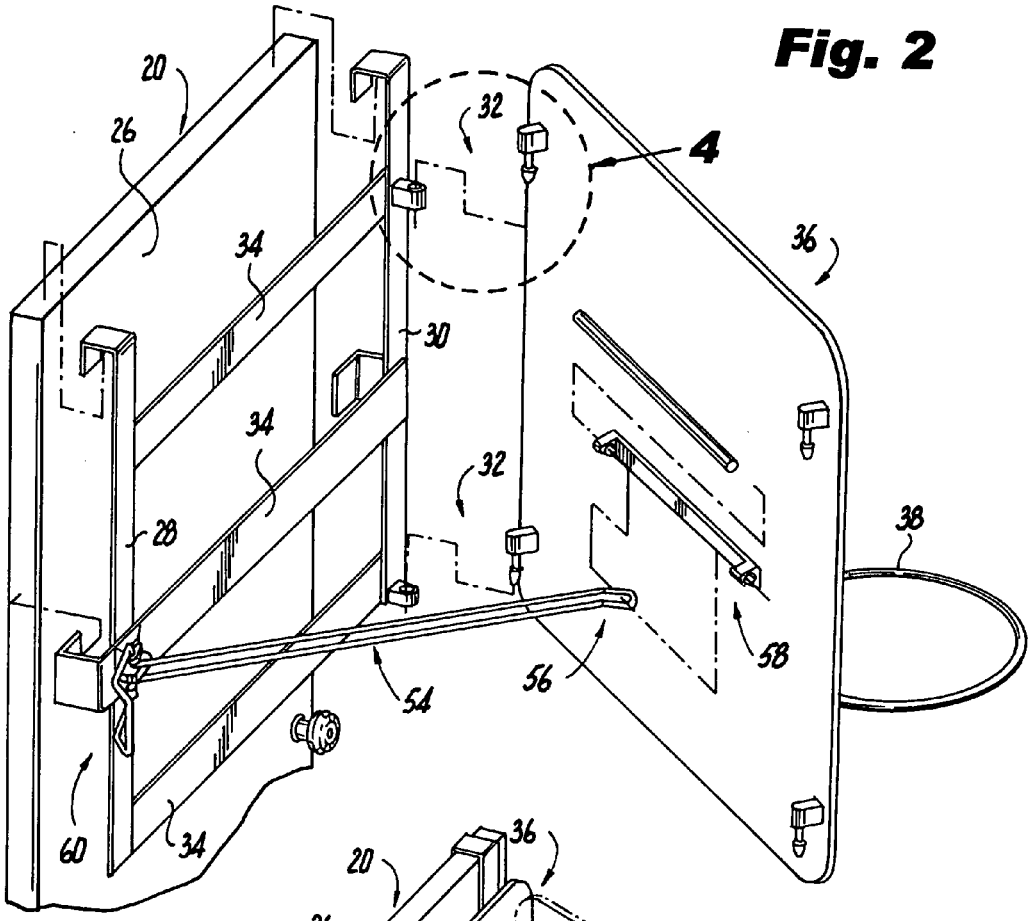
FIG. 2 is a rear elevational view projected from FIG. 1 illustrating details of the attachment of the backboard and hoop from support structure on a door at the site of use.
Figure 5:
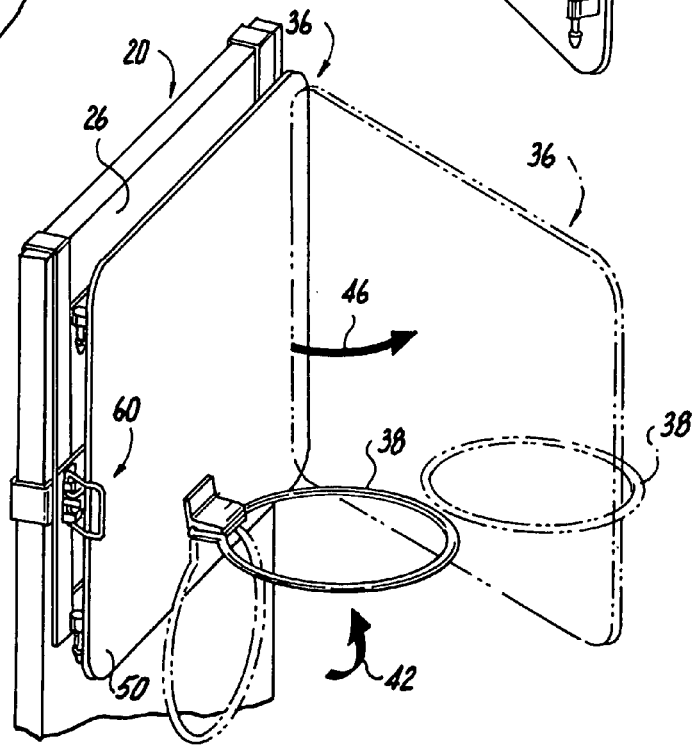
FIG. 5 is a partial front elevational view projected from FIG. 1 illustrating in full line and phantom perspective positions of movement of the backboard and hoop.
Figure 6:
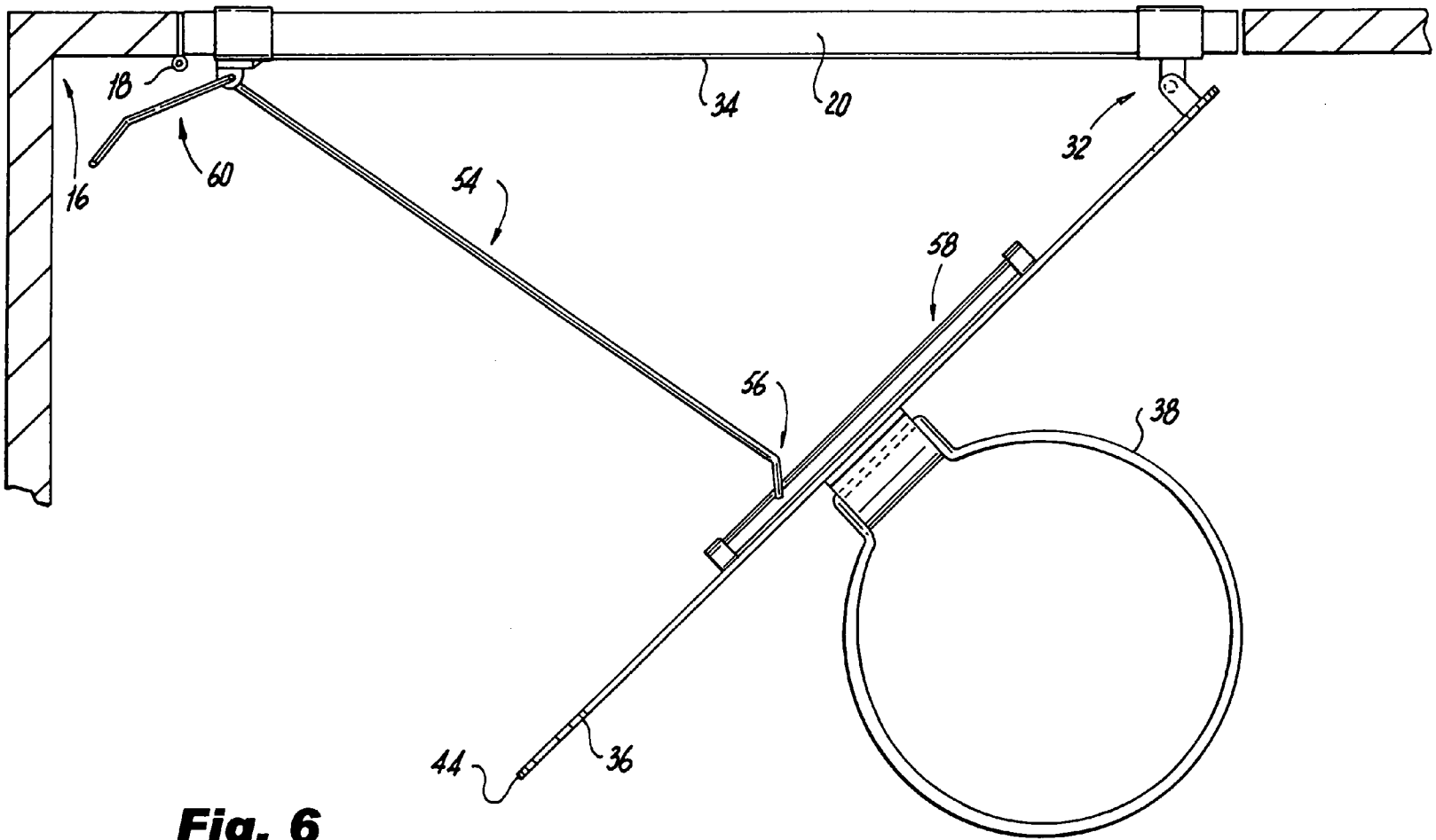
FIG. 6 is a plan view of the backboard and hoop.
Figure 7:
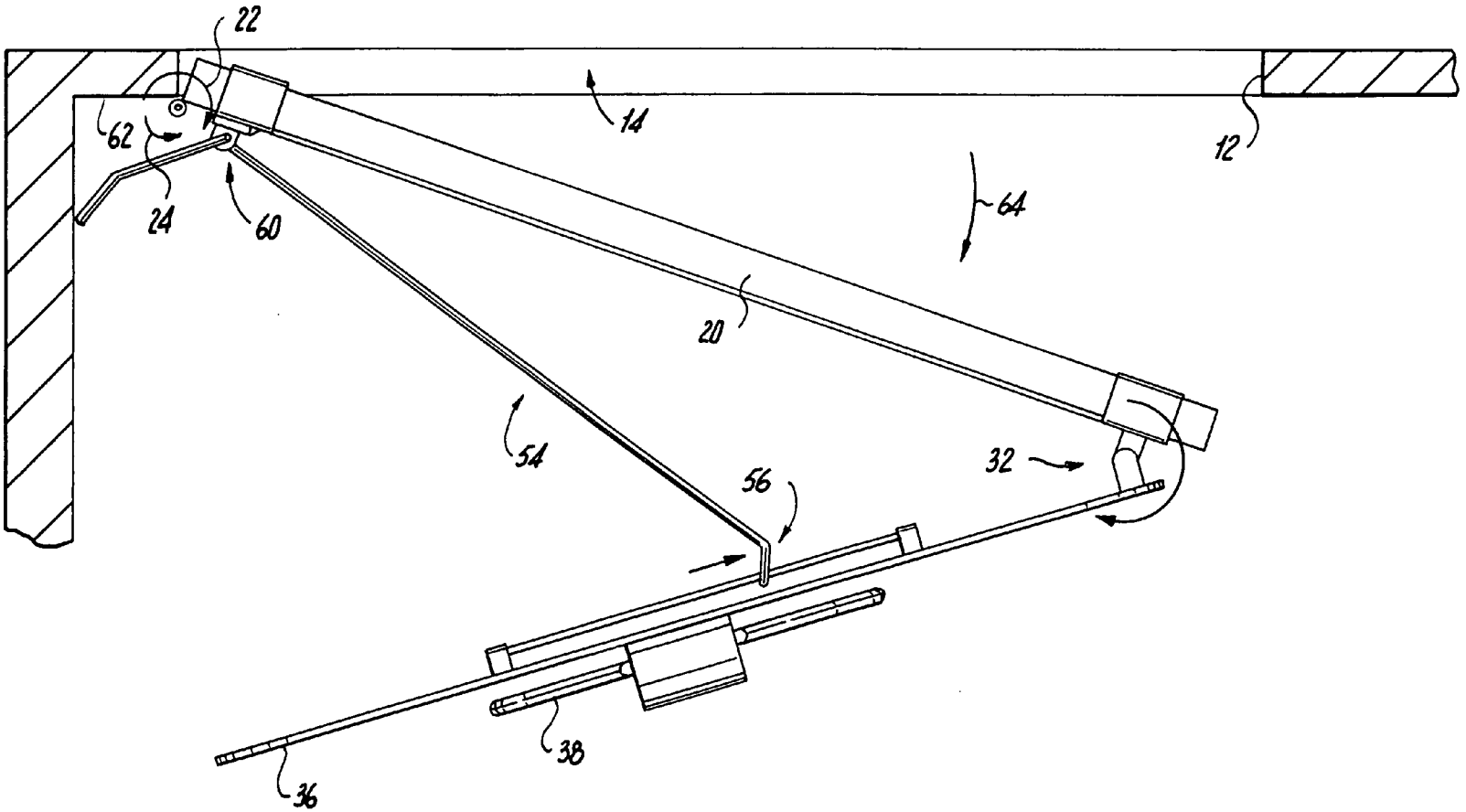
FIG. 7 is similarly a plan view illustrating degrees of movement of the backboard and structures thereon.
Figure 8:
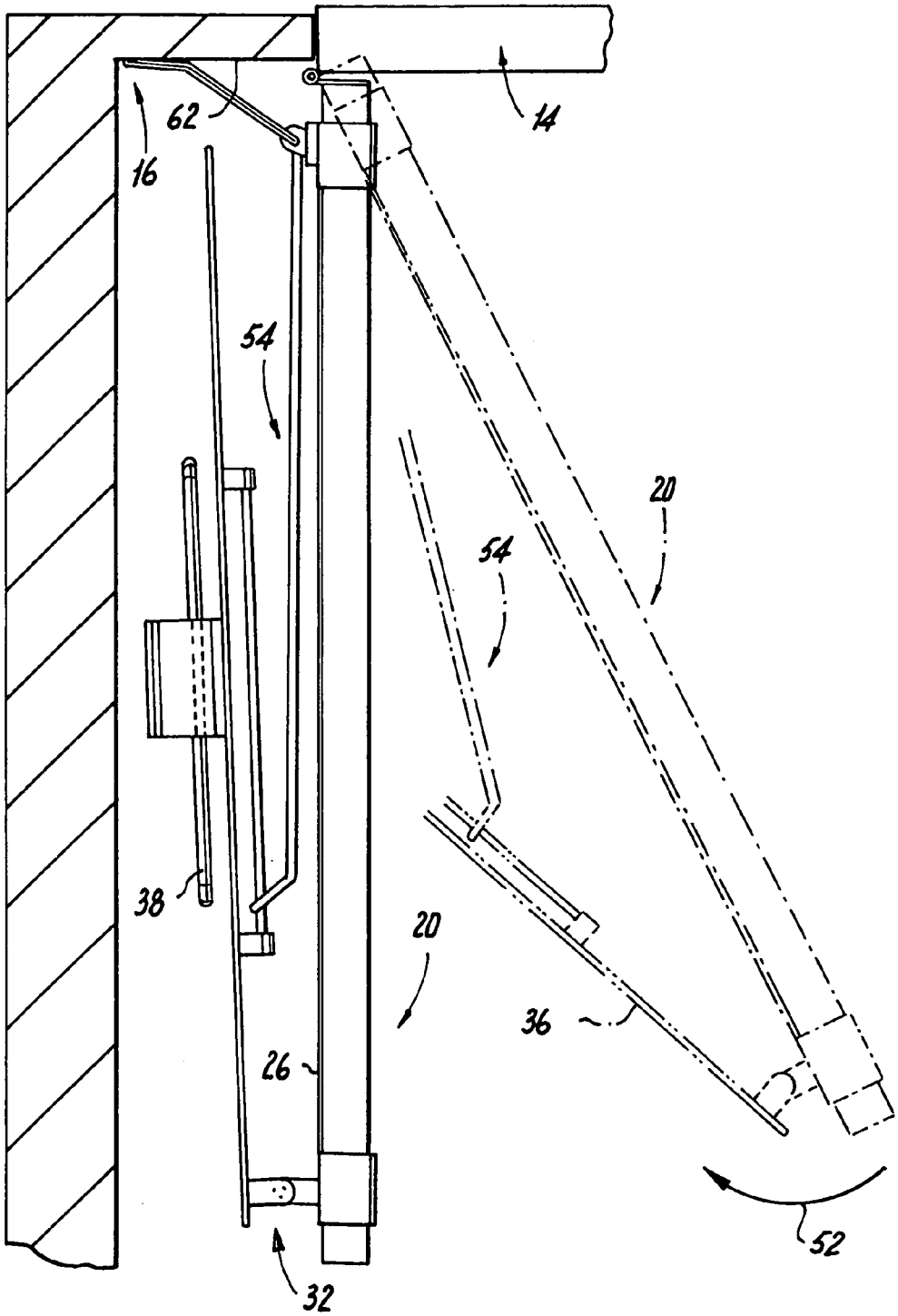
FIG. 8 is similarly a plan view illustrating in full line and phantom line perspective the closing movement of the backboard and hoop into non-use storage conditions.

Intended primary for indoor home basketball practice in a rectangular room, such as a bedroom 10 or the like, which has edges, individually and collectively designated 12 bounding a door opening 14 adjacent a room corner 10 in which is hingedly mounted, as at 18, a door 20 partaking of opening 22 and closing 24 movements relative to the opening 14, wherein there is supported on the rear 26 of the door 20 by straps 28 and 30, a basketball backboard 36, hinged at 32, and cooperating basketball hoop 38, the latter having a front connector 40 allowing pivotal movement 42.

When not in use, the backboard and hoop 36, 38 are stored flat against the door 20 so as not to impede access into and out of the room through the door opening 14. When however in use, the door 20 is closed and from inside the room 10 a side edge 44 of the backboard 36 is urged through a pivotal traverse 46 about the hinges 32 so as to assume a cater-corner relation to the room corner 16 which maximizes the play area using a basketball 37 facing and below the basketball hoop 38 since it is correlated to the maximum dimensional size, as noted by the reference arrow 48 of the room 10.

When practice is voluntarily terminated from within the room 10, the backboard 36 with the hoop 38 is folded flat against the front surface 50 preparatory to being returned to its flat storage condition, and wherein the closing pivotal traverse 52 urges an operative component 54 having an end 56 serving as a horizontally oriented configuration of wire construction material in tracking relation in a track 58 and an opposite end in an L-shaped bracket configuration 60 having an adjacent position forwardly of a wall 62 delimiting the room corner 16 so that opening of the door 20 results in contact of bracket 60 against the wall 62 and the urging in closing movement 52 of the backboard 36 again in a desired flat out-of-way storage condition against the door 20 and thus not impeding access into an out of the room 10 through the opening 14.

In the event the practice within the room 10 is not voluntarily terminated as just noted, an individual from outside the room 10 for good reason, such as to supervise the activity within the room 10, is able by urging the door 20 in opening movement 64 to cause contact of the bracket 60 against the wall 62 and, as previously described, the return of the backboard and hoop 36, 38 to an unimpeding condition in the door opening 14.

While the described basketball backboard and hoop for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. For an assembly of a basketball backboard and hoop having play value for a teenager when used in an indoor rectangular shaped room bounded by four walls, said play value-providing method of usage comprising the steps of:

A. selecting as a site of use a corner intersection of said room formed by an adjacent two walls;

B. using a door in one of said two walls hingedly mounted for opening and closing pivotal traverses;

C. supporting a backboard of said assembly on said door in said door closed position having a rectangular shape with a first side edge and a second opposite side edge oriented (1) with said first side edge remote from said corner in attached relation to said door and (2) with said second side edge adjacent to said corner in unattached relation to said door;

D. an operative position in manual urging of said backboard by said unattached edge thereof in a pivotal traverse away from said door into a cater-cornered relation to said room corner and in facing relation to a diagonal expanse of said room;

E. using a bracket of wire construction material having a first end of an L-shaped configuration and an opposite second end and (1) said first end rotatably mounted on said door; and (2) said second end mounted for sliding movement along a rear surface of said backboard; and F. an operative position in manual urging of said door into said open position thereof effective to contact said L-shaped configuration causing rotative movement thereof and corresponding sliding movement of said bracket second end;

whereby said backboard from said cater-cornered orientation having play value when in playing use is urged through closing movement against said back of said door convenient for storage when not in use.

2. A method of playing basketball indoors as claimed in claim 1 using a rod mounted in a position rearwardly of said back of said door to serve as a track for said sliding movement of said bracket second end.

* * * * *